United States Patent [19]

Ruiz et al.

[11] 4,314,404

[45] Feb. 9, 1982

[54] RAZOR WITH PRE-WETTING OR CAPILLARIZER SYSTEM

[76] Inventors: Rene A. Ruiz; George Spector, both of 3615 Woolworth Bldg. 233 Broadway, New York, N.Y. 10007

[21] Appl. No.: 123,001

[22] Filed: Feb. 20, 1980

[51] Int. Cl.[3] ..... B26B 21/00
[52] U.S. Cl. ..... 30/41
[58] Field of Search ..... 30/41, 41.5

[56] References Cited

U.S. PATENT DOCUMENTS

| | | | |
|---|---|---|---|
| 1,556,269 | 10/1925 | Warming | 30/41 |
| 2,375,444 | 5/1945 | Schwartz | 30/41 |
| 3,417,464 | 12/1968 | Miyauchi | 30/41 |

*Primary Examiner*—Jimmy C. Peters

[57] ABSTRACT

A safety razor including a replacable container inserted into the handle, the container having a pressurized beard-wetting agent therein that is dispensed in selected amounts, by a mechanism, toward the razor head where foam rubber pads absorb the agent and dispense it onto the skin in front of the blade edge.

3 Claims, 7 Drawing Figures

10
11
12
13
14
15
16
17
18
19
20
21
22
23
24
25
26
27
28
29
29A
30
31
32
33
34
35
36
37
38
39
40
41
42
43
44
45
46
47
48
49
50
51
52
53
54
55

RAZOR WITH PRE-WETTING OR CAPILLARIZER SYSTEM

This invention relates generally to safety razors.

It is well known that a person must first lather up a beard so as to soften the hairs before they can be easily shaved off. Accordingly, up till now a lathering soap in a shaving mug has been applied by a brush, or else a soap dispensed foaming from a pressurized can was first dabbed on the skin and rubbed in by a person's fingers before a razor was applied for shaving. These preliminary steps required extra equipment and took extra time.

Accordingly, it is a principal object of the present invention to provide a razor having a self-contained beard pre-wetting system that eliminates any preliminary beard softening operations prior to shaving, so as to save time and do away with any other extra equipment cluttering a bathroom medicine cabinet.

Another object is to provide a razor with pre-wetting or capillarizer system that is adaptable for use in either a standard double or single edge safety razor, and which is adaptable for both men's or women's safety razors.

Still another object is to provide a razor with pre-wetting or cappillarizer system which does not require and use of water.

Figures 1, 2, 3, 4, 5, 6, 7:
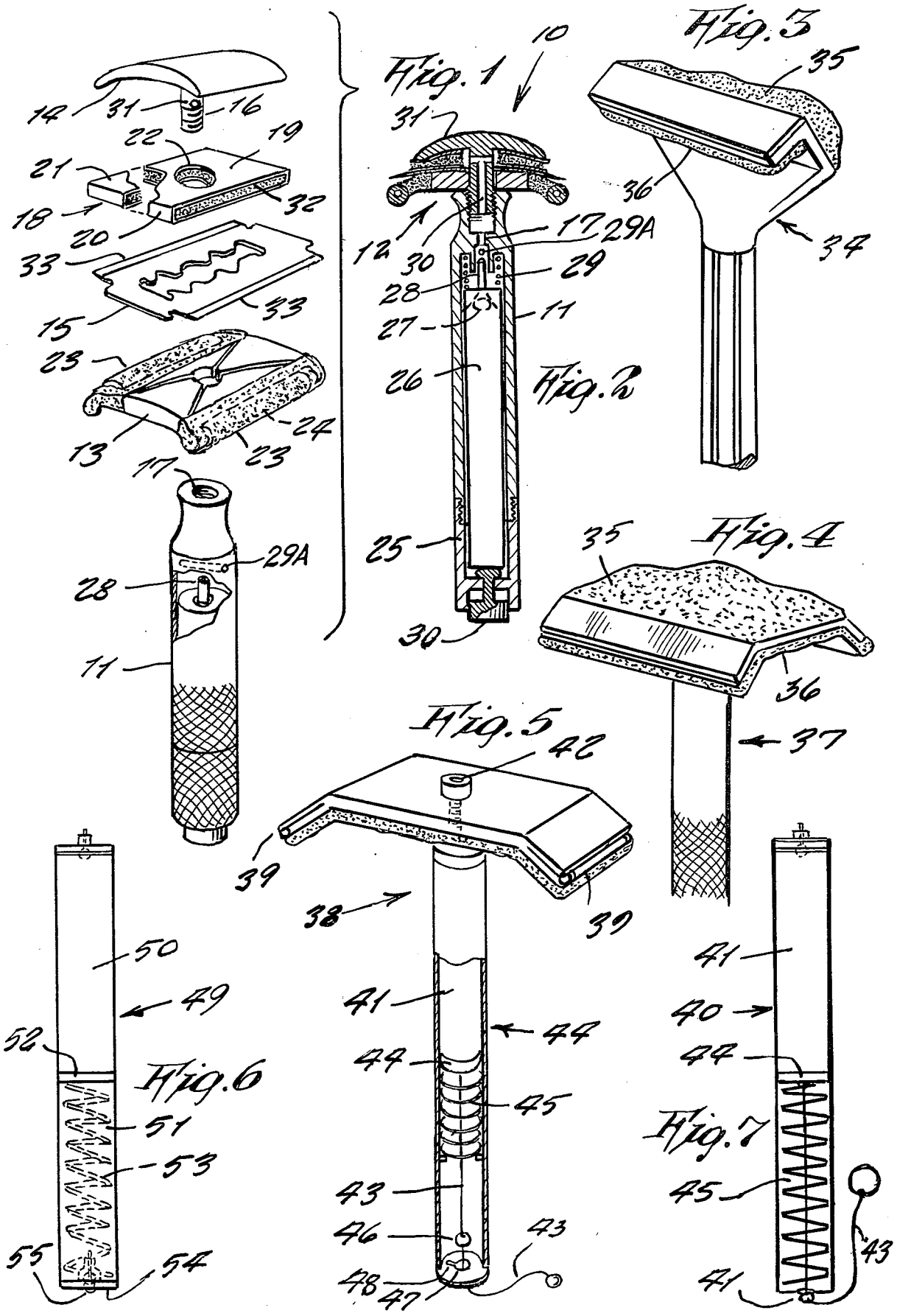
FIG. 1 is an exploded perspective view of one design of the invention.
FIG. 2 is a side cross sectional view thereof, shown assembled.
FIG. 3 is a perspective view of another design thereof for a single edge safety razor.
FIG. 4 is a perspective view of still another design for a double edge safety razor.
FIG. 5 is a perspective view of a further modified design of the double edge safety razor.
FIG. 6 is a side view of one design of pre-wetting agent cartridge.
FIG. 7 is a side view of the cartridge shown in FIG. 6.

Referring now to the drawing in greater detail, and more particularly to FIGS. 1 and 2 thereof at this time, the reference numeral 10 represents a safety razor according to the present invention wherein there is a handle 11, and a head 12 mounted on one end of the handle and consisting of a conventional pressure plate 13 and a clamp plate 14 that serve as guards between which a razor blade 15 is held, the clamp plate having a threaded stem 16 extending through the pressure plate and screwed in a threaded end of a hole 17 in the handle.

In the present invention, a foam rubber pad 18 is placed between the clamp plate and the razor blade, the pad being coated on opposite sides 19 and opposite end edges 20 with a waterproof sealant 21. A central hole 22 through the pad clears the stem 16 passing therethrough.

Also in this design a foam rubber pad 23 is applied around each leading edge 24 of the pressure plate, the edge being either conventionally toothed or being annularly grooved rotatable roller.

Additionally in this design the handle is hollow and has a removable, screw-on end cap 25 so as to permit insertion of a replaceable cartridge 26 therein which contains a pre-wetting agent under pressure. A valve 27 within one end thereof includes an outwardly extending stem 28 which when depressed causes the agent to be dispensed around the stem. The cartridge is located between a compression coil spring 29 and a push button 30 slidable in the end cap so that when the push button is depressed, the cartridge is moved against the spring and causes the stem 28 to abut against a transverse pin 29A in the handle so as to open the valve and allow the pre-wetting agent to be dispensed into the hole 17. From there, it is pushed through a central hole 30 in the clamp plate stem and into a transverse hole 31 thereof and into the central hole 22 of the pad from where it saturates into the pad 18. The opposite sides 32 of the pad being left uncoated with the sealant, allows the pre-wetting agent to be dispensed outward therefrom and upon a skin and beard, in a vicinity of the blade cutting edges 33. Thus, the agent also transfers therefrom to the pads 23 so that the blade cutting edges are surrounded on both sides with the pre-wetting agent that softens the beard and required no water being used. Thus, the beard is easily prepared for shaving by simply depressing the push button, and requiring no additional equipment clutter, such as shaving mug brush or separate pressurized soap can.

In FIG. 3, a single edge injector razor 34 includes foam rubber pads 35 and 36 above and below the blade cutting edge, the pad 35 being thicker so to store the agent during a shaving operation.

In FIG. 4, the double edge razor 37 is likewise equipped with the pads 35 and 36.

In FIG. 5, another model of double edge razor 38 is of narrow type and includes a foam rubber pad on its underside for dispensing the agent to a roller 39 closely aligned to the blade edge and rolling the agent on the skin and beard hairs. The handle contains a cartridge 40 having a pressurized container 41 containing the pre-wetting agent for dispensing from a hole 42 of the razor head and into which the container valve stem extends. A cord 43 pulls on a piston 44 against a compression coil spring 45 a bead 46 affixed along the cord being moved outward of a hole 47 in the end of the cartridge so as to be locked behind a slot 48 and thus allow a slow steady dispensing of the agent during a shaving operation.

A cartridge 49 shown in FIG. 6 includes a container 50 containing the agent, and a compressed air chamber 51 containing a piston 52 bearing against the agent container. A compression coil spring 53 bears at one end against the container and bears at its other end against an end wall 54 fitted with a check valve 55 for charging the chamber with air.

What is claimed as new, is:

1. A safety razor, comprising in combination, a handle, a head on one end of said handle comprising a pressure plate and a clamp plate with a blade therebetween, a foam rubber pad between said blade and said clamp plate, and a replaceable cartridge in said handle dispensing a pre-wetting agent to said pad, including means for conducting said agent to said pad through said handle and head in further combination with a second pad secured to said pressure plate abutting said blade, underside including a second means for conducting said agent to said second pad.

2. A razor as in claim 1, wherein the first said means comprises conduits from said cartridge through said handle and head to an annular space between said clamp plate and the first said pad and wherein said second means comprise channels communicating with the first means and said second pad.

3. A razor as in claim 1, including a valve mounted on said cartridge responsive to movement of said cartridge to exit said agent to said first means in combination with external operator for effecting such movement.

* * * * *